United States Patent [19]

Holland-Letz

[11] 4,389,934

[45] Jun. 28, 1983

[54] HAND LABELLING APPARATUS

[75] Inventor: Günter Holland-Letz, Hirschhorn, Fed. Rep. of Germany

[73] Assignee: Esselte Pendaflex Corporation, Garden City, N.Y.

[21] Appl. No.: 284,203

[22] Filed: Jul. 17, 1981

[51] Int. Cl.[3] ..... B41L 47/46

[52] U.S. Cl. ..... 101/92; 101/288; 101/219

[58] Field of Search ..... 101/92, 93.24, 93.25, 101/110, 288, 291, 292, 93.25, 93.18; 156/384, 577, 579, DIG. 48, DIG. 49; 226/123, 143

[56] References Cited

U.S. PATENT DOCUMENTS

| | | | |
|---|---|---|---|
| 3,330,207 | 7/1967 | DeMan | 101/92 |
| 3,911,817 | 10/1975 | Becker et al. | 101/291 |
| 4,041,863 | 8/1977 | Mullen et al. | 101/107 |
| 4,043,440 | 8/1977 | Busch | 400/620 |
| 4,102,731 | 7/1978 | Hamisch, Jr. | 156/597 |
| 4,125,074 | 11/1978 | Sato | 101/288 |

*Primary Examiner*—Edgar S. Burr
*Assistant Examiner*—Bradley M. Lewis
*Attorney, Agent, or Firm*—Gerald J. Ferguson, Jr.; Joseph J. Baker

[57] ABSTRACT

In a hand labelling apparatus for printing and dispensing labels from a label strip including a carrier tape where the labels are adhered to the tape, a tape feed mechanism for stepwise feeding the label strip in a forward direction to a peel edge at which point the labels are substantially separated from the carrier tape, a printing mechanism having changeable type where the distance between the printing zone of the printing mechanism and the peel edge exceeds the length of each of the labels, a return member for feeding the label strip in a return direction opposite to the forward direction, an operating lever pivotable between a rest position and a working position where the operating lever is connected to the return member and the tape feed and printing mechanisms so that, during movement of the operating lever from the rest position to the working position, the return member feeds the labels in the return direction to the print zone where one of them is printed, a return stop member for disabling the return member for a predetermined portion of the movement of the operating lever between its rest and working positions so that the label strip movement in the forward direction exceeds that in the return direction by an amount equal to the length of one label so that no printed labels remain in the labelling apparatus even though the distance between the peel edge and the printing zone exceeds the length of each label.

12 Claims, 6 Drawing Figures

HAND LABELLING APPARATUS

BACKGROUND AND SUMMARY OF THE INVENTION

The present invention relates to a hand labelling apparatus which in a working cycle imprints and dispenses pressure-sensitive labels adhering to a carrier tape, comprising a feed means which under the control of an operating lever pivotal between a rest position and a working position draws the carrier tape stepwise about a peel edge at which in each working cycle a pressure-sensitive label on feeding in a forward direction detaches from the carrier tape and moves into a dispensing position, and a printing mechanism which in each working cycle at a printing zone remote from the peel edge oppositely to the forward direction produces an imprint on a pressure-sensitive label.

In an apparatus of this type known from DE-PS No. 2,345,249 the imprinting of the pressure-sensitive labels takes place in a printing zone which is two label lengths away from the peel edge in a direction opposite to the forward direction of the carrier tape. This means that the pressure-sensitive label which is brought in an operating cycle into the dispensing position in which it can be applied to an article has already been imprinted in the previous operating cycle. Thus, after the application of the label to an article, before the start of the next operating cycle a label provided with an imprint is already present in the apparatus. If the imprint to be applied is changed this label must be removed from the apparatus so that only labels provided with the changed imprint are applied to articles. Since the imprints on the labels are usually sales prices the presence of a label with an old price imprint is highly undesirable because articles can be marked with the wrong price if the operator forgets to remove the already imprinted label from the apparatus after a price change.

The objective of the present invention is to provide an apparatus of the type outlined at the beginning which is such that even with a relatively large distance between the peel edge and the printing zone after completion of an operating cycle there is no already imprinted but undispensed pressure-sensitive label in the apparatus.

According to the invention this objective is achieved in that the feed means comprises a tape feed mechanism which is driven by the operating lever and which on the movement of the operating lever from the rest position to the work position moves the carrier tape in the return direction opposite the forward direction through at least a distance which is equal to the distance of the peel edge from the printing zone and which on the return of the operating lever from the working position to the rest position moves the carrier tape in the forward direction through the same distance plus one label length. In the apparatus according to the invention the carrier tape with the pressure-sensitive labels adhered thereto is moved in each operating cycle in a so called pilgrim step movement which means that the label disposed at the peel edge is first brought back to the printing zone, whereupon after the printing operation it is again transported in the forward direction to the peel edge and beyond into the dispensing position. This means that in each operating cycle only one pressure-sensitive label is imprinted which is then also the label which is brought in the same operating cycle into the dispensing position and can be attached to an article. If the imprint to be produced on the label is changed, because of the construction of the hand labelling apparatus according to the invention the next label dispensed already bears the new imprint. The removal of labels already provided with the old imprint in previous operating cycles is thus not necessary and consequently there is no danger of applying incorrectly imprinted labels.

DETAILED DESCRIPTION OF THE INVENTION

Figure 1:
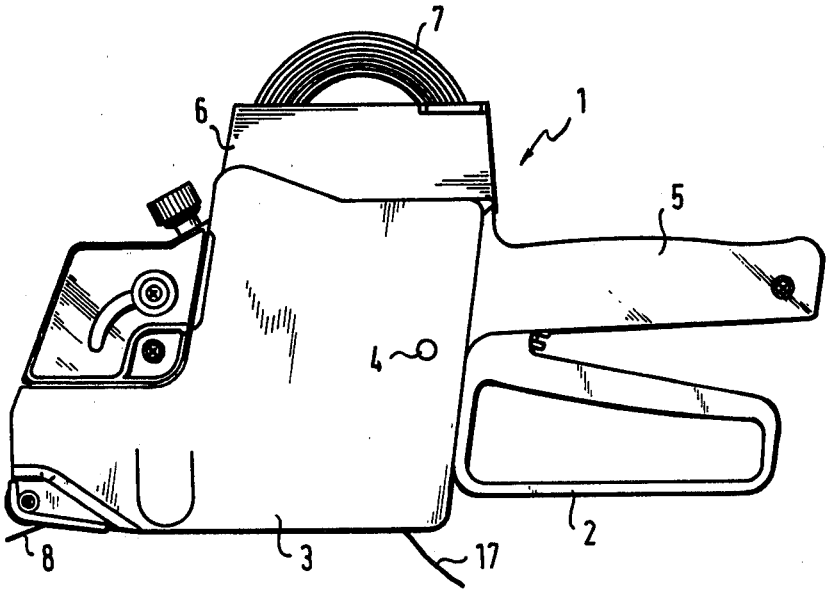
FIG. 1 is a side view of the apparatus according to the invention.

FIG. 1 illustrates a hand labelling apparatus 1 with the aid of which pressure-sensitive labels adhering to a carrier tape can be imprinted and dispensed for application to an article. The apparatus 1 comprises an operating lever 2 which is pivotally mounted about a shaft 4 fixedly connected to the apparatus housing 3 between the rest position illustrated in FIG. 1 and a working position in which said lever is squeezed against the grip 5 fixed with respect to the housing.

A well 6 disposed at the housing upper side serves to accommodate a carrier tape supply roll 7. From the supply roll 7 the carrier tape with its pressure-sensitive labels adhering thereto passes to a peel edge which is at the bottom left in the illustration of FIG. 1 and at which in each operating cycle, i.e. on pivoting the operating lever 2 from the rest position to the working position and then back into the rest position, a pressure-sensitive label detaches from the carrier tape and moves into a dispensing position in which it can be applied to an article. In FIG. 1 a pressure-sensitive label 8 is illustrated in the dispensing position.

Figure 2:
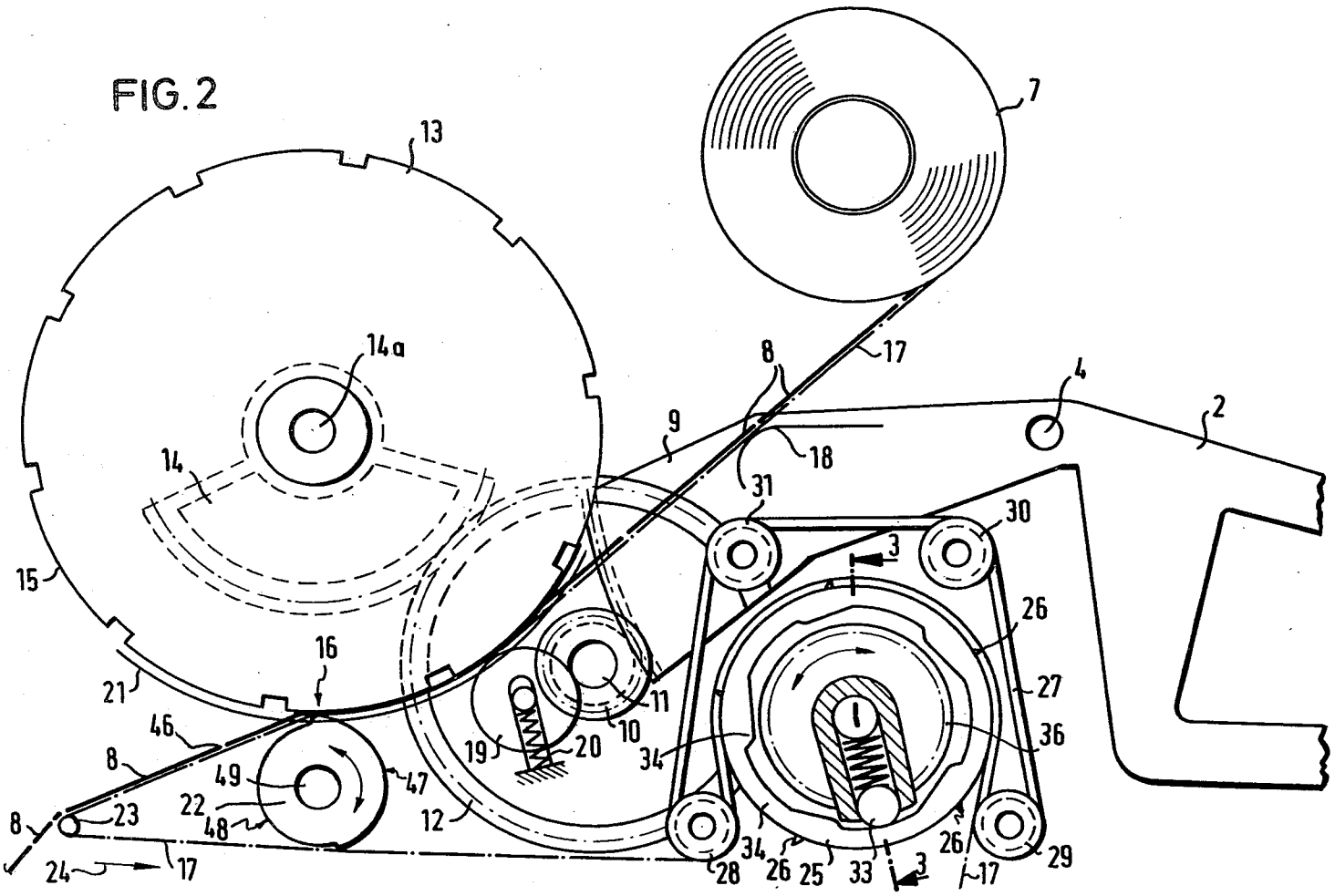
FIG. 2 is a schematic side view of the drive members essential to the transport of the carrier tape in the basic position.

In FIG. 2 the parts of the labelling apparatus 1 required for transport of the carrier tape 17 are shown diagrammatically. Also illustrated diagrammatically is the operating lever 2 which is pivotal about the axis 4 and which comprises a toothed segment 9 with the aid of which its pivot movement can be utilised for the drive of the actual transport members. The toothed segment 9 is in engagement with a pinion 10 which is non-rotatably mounted on a shaft 11. Also non-rotatably connected to said shaft 11 is a toothed wheel 12 and thus pinion 10, shaft 11 and toothed wheel 12 rotate as a whole. Wheel 12 meshes with a toothed segment 14 rigidly connected to the type wheel 13 of a rotary printing mechanism. The type wheel 13 and the toothed segment 14 are pivotally mounted about a shaft 14*a*.

The type wheel 13 comprises a print segment 15 in which the print types are disposed which are to produce an imprint in a printing zone on a pressure-sensitive label 8 on the carrier tape 17. The print types may be numbers, letters, or, if a bar code is to be printed, bar-like types of different width. The type wheel 13 is composed of a plurality of discs provided at their peripheral surface with print types. By rotation of the individual discs about the axis 14*a* the individual print types can be moved to the print segment and consequently at said print segment print types of adjacent discs can be assembled in any desired manner.

The carrier tape 17 with the pressure-sensitive labels 8 adhering thereto is led from the supply roll 7 via a spring metal plate 18, which holds the carrier tape 17 tight, to a roller 19 which presses said tape under the action of a spring 20 against the peripheral surface of the type wheel 13. In the region of the type wheel periphery which adjoins the print segment 15 in the anticlockwise direction a guard plate 21 is arranged so that the roller 19 does not press the carrier tape 17 with the pressure-sensitive labels 8 directly against the type wheel peripheral surface but against the guard plate 21 disposed at said region of said peripheral surface.

The carrier tape 17 is led further between a pressure roller 22 engaging the type wheel 13 via a tooth connection and the type wheel 13 and then passes to a peel edge 23. When the carrier tape 17 is drawn about the peel edge 23 in the forward direction indicated by the arrow 24 the pressure-sensitive labels 8 detach from the carrier tape so that they move into the peel position. A pressure-sensitive label 8 disposed in the peel position is illustrated in FIG. 2 in dashed line.

The carrier tape 17 then runs further to a feed roll 25 about which it is led with a relatively large wrap angle. The feed roll 25 is provided with projections 26 which engage in slit-like recesses in the carrier tape 17. The slits in the carrier tape 17 are arranged at a distance apart which corresponds to the length of a pressure-sensitive label 8. The projections 26 on the feed roll 25 are arranged exactly with the spacing of the slits in the carrier tape 17 so that in the course of the individual operating cycles of the apparatus the carrier tape 17 assumes an exactly defined position when the projections 26 are in engagement with the slits in the carrier tape 17.

To hold the carrier tape 17 reliably in engagement with the peripheral surface of the feed roll 25 coil springs 27 are provided which are led over rollers 28, 29, 30 and 31 and engage round the feed roll 25 as well as the carrier tape 17. The carrier tape is thereby led between the peripheral surface of the feed roll 25 and the worm springs 27.

Figure 3:
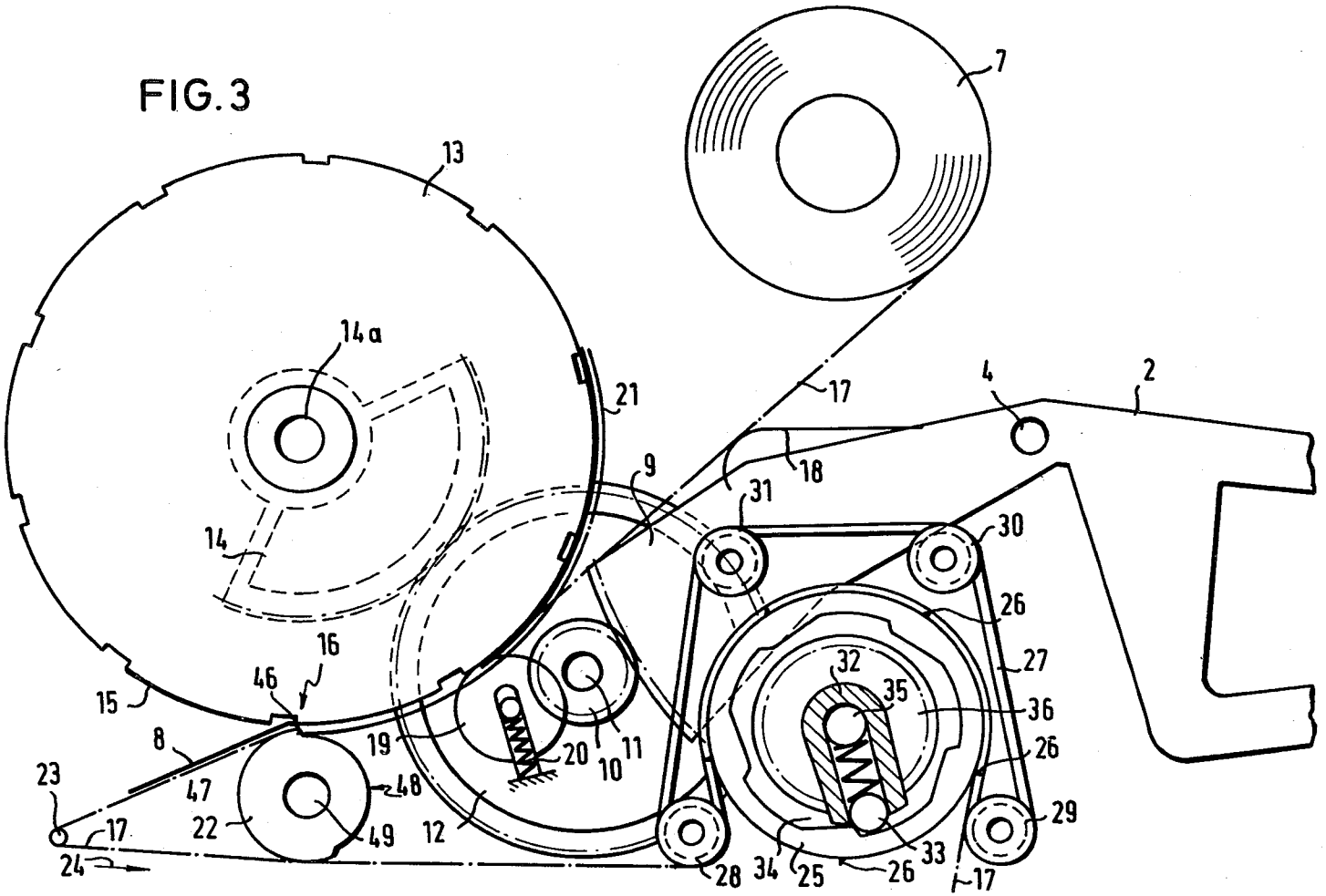
FIG. 3 is a view similar to FIG. 1 but the drive members are in the position immediately prior to start of the synchronous carrier tape movement in the return direction.

Associated with the feed roll 25 is a return stop 32 which is fixedly connected to the apparatus housing 3 and which assumes the position illustrated in FIGS. 2 and 3. The return stop 32 includes a return detent member 33 which consists of a spring-loaded ball. Said spring-loaded detent member 33 cooperates with detent teeth 34 which are disposed on an inwardly directed peripheral surface of the feed roll 25. As is apparent, the return stop 32 permits a rotation of the feed roll 25 clockwise but because of the detent teeth 34 opposes a rotation in the anticlockwise direction. The feed roll 25 can only be rotated in the anticlockwise direction when the spring force exerted on the return detent member 33 has been overcome. The return detent member 33 then practically jumps over the detent tooth 34 so that the feed roll 25 can further rotate freely until the next detent tooth 34 comes into engagement with the return detent member 33.

Figure 4:
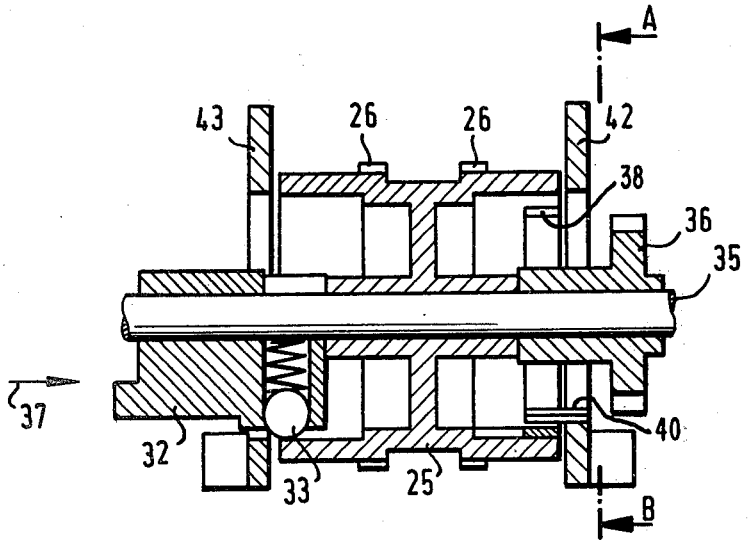
FIG. 4 is a section through the feed roll along the line 3—3 of FIG. 2.

A drive wheel 36 is rotatably mounted on the shaft 35 on which the feed roll 25 is rotatably mounted and is illustrated in FIG. 4. Remembering that in FIGS. 2 and 3 the feed roll 25 is viewed in the direction of the arrow 37 indicated in FIG. 4, then the drive wheel 36 in the illustrations of FIGS. 2 and 3 is at the back of the feed roll 25.

The drive wheel 36 can be rotated via the tooth wheel 12 and the toothed segment 9 by pivoting the operating lever 2. The connection between the drive wheel 36 and the feed roll 25 is formed by a directional ratchet mechanism which includes forward pawls 38 rigidly connected to the drive wheel 36 and cooperating with forward detent teeth 39 on the feed roll 25. This ratchet mechanism permits the feed roll 25 when the drive wheel 36 is held stationary to rotate clockwise in the view of FIGS. 2 and 3, preventing a rotation in the anticlockwise direction. It should be noted that these rotational directions are reversed in the views of FIGS. 5 and 6 because in these Figures the feed roll is observed from the back with respect to FIGS. 2 and 3. Thus, in FIGS. 5 and 6 the ratchet mechanism permits a relative rotation of the feed roll 25 with respect to the drive wheel 36 in the counterclockwise direction but prevents a rotation in the clockwise direction.

Figure 5:
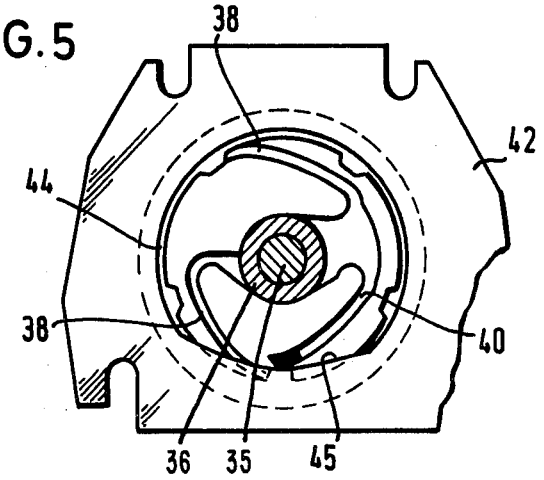
FIG. 5 is a partially sectioned view of the feed roll viewed as indicated by the arrows A and B in a position of the feed roll as in FIG. 2
Figure 6:
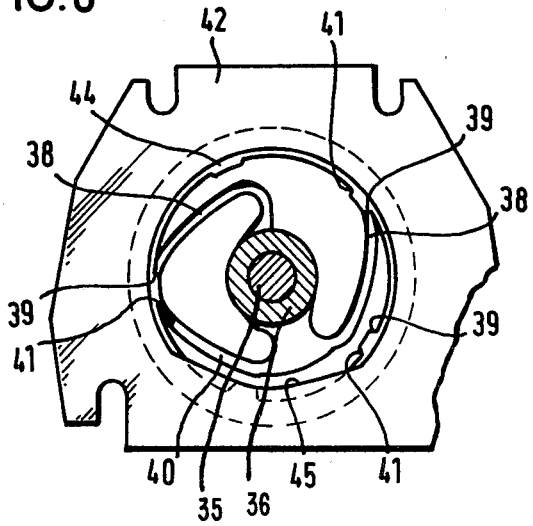
FIG. 6 is a similar view to FIG. 4 but with the feed roll assuming the position of FIG. 3.

It is apparent from FIGS. 5 and 6 that not only the forward pawls 38 are rigidly connected to the drive wheel but also a return pawl 40 which cooperates with drive teeth 41 on an inner peripheral surface of the feed roll 25. As apparent from FIG. 6 the feed roll 25 is driven by means of the return pawl 40 in the clockwise direction when in the course of the rotation of the drive wheel 36 the return pawl 40 comes against a return drive tooth 41.

According to FIG. 4 the feed roll 25 is mounted between two walls 42 and 43 which are fixedly connected to the apparatus housing 3. In the wall 42 an opening 44 is formed whose periphery is described by a circle round the axis 35 of the feed roll 25 with the exception of a limited peripheral region. As can be seen from FIGS. 5 and 6 the periphery of the opening 44 differs in its lower peripheral region from the circular form and forms a control face 45 whose spacing from the axis 35 is less than at the remaining regions of the opening periphery. The function of this control face 45 is apparent on consideration of FIG. 4 in conjunction with FIGS. 5 and 6.

According to FIG. 4 the return pawl 40 projects in the lateral direction from the right end face of the feed roll 25. When the drive wheel 36 assumes the position illustrated in FIG. 5 the portion of the return pawl 40 projecting at the end face of the feed roll 25 bears on the control face 45 so that the return pawl 40 cannot come into engagement with a return drive tooth 41 on the feed roll 25. Only when the drive wheel 36 and the return pawl 40 rigidly connected thereto have rotated to such an extent that the return pawl 40 is no longer supported by the control face 45 can the return pawl 40 act on a drive tooth 41 on the feed roll 25. Such a position of the drive wheel 36 is illustrated in FIG. 6. On further rotation of the drive wheel 36 the return pawl 40, by acting on the return drive tooth 41, drives the feed roll 25 in the clockwise direction in the illustration of FIG. 6.

After this description of the drive components necessary for the carrier belt movement, their respective positions and their individual effects, the operations will now be described which take place in the course of an operating cycle, i.e. on pivoting of the operating lever out of the rest position into the working position and back again into the rest position.

At the start of an operating cycle the drive members assume the basic positions illustrated in FIG. 2. The basic positions of the forward pawls 38 and the return pawl 40 are shown in FIG. 5. As soon as the operating lever 2 is squeezed against the grip 5 the toothed segment 9 moves anticlockwise about the axis 4 so that the pinion 10, which is in engagement with the toothed segment 9, rotates in the clockwise direction in the view of FIG. 2. In the same manner the toothed wheel 12 fixed in rotation with the shaft 11 of the pinion rotates in the clockwise direction so that the type wheel 13 is thereby also rotated anticlockwise by means of the toothed segment 14 rigidly connected thereto.

The toothed wheel 12 also rotates the drive wheel 36 in the illustration of FIG. 2 anticlockwise (clockwise in the illustration of FIG. 5) and as a result the forward pawls 38 in the illustration of FIG. 5 begin to move away in the clockwise direction from the forward detent teeth 39. Since due to the action between the roller 19 and the guard plate 21 disposed at the type wheel periphery the carrier tape is frictionally entrained in the return direction, i.e. in the direction towards the carrier tape supply roll 7, this tensile force also moves the feed roll 25 anticlockwise in FIG. 2. This means in practice that the feed roll 25 follows the rotation of the drive wheel 36. The relative position of the forward pawls 38 and of the drive wheel 36 with respect to the feed roll 25 is thus not changed. The feed roll 25 can however follow the movement of the drive wheel 36 only until the return detent member 33 comes into engagement with the next detent tooth 34. In the example of embodiment illustrated the rearwardly directed movement of the carrier tape 17 continues until the leading —considered in the return direction—edge 46 of the pressure-sensitive label 8 adjoining the peel edge 23 has been pulled back to the printing zone 16. With the respective dimensions indicated in FIG. 2 the rearwardly directed travel in this initial phase is about half the label length.

The type wheel 13 also rotates via a toothed connection the pressure roller 22 which comprises a peripheral portion 47 of larger radius and a peripheral portion 48 of smaller radius. The larger radius is so dimensioned that it is exactly equal to the distance of the axis 49 of rotation of the pressure roller 22 from the periphery of the type wheel. The shaft 49 of the pressure roller 22 is biased in the direction towards the type wheel by a spring which is not illustrated when the peripheral portion 47 is in engagement with the type wheel periphery. The spring is however ineffective when the peripheral portion 48 with smaller radius is opposite the type wheel 13 so that in this case the carrier tape 17 can move freely between the pressure roller 22 and the type wheel periphery. FIG. 2 shows that the carrier tape, immediately after the start of the rotation of the type wheel 13 anticlockwise and thus after the start of the rotation of the pressure roller 22 clockwise, can be freely drawn between the pressure roller 22 and the type wheel 13.

When the return detent member 33 has come into engagement with the detent tooth 34 a further rotation of the feed roll 25 is prevented. The entraining force produced by friction between the roller 19, the carrier tape 17 and the guard plate 21 at the type wheel 13, which acts as pulling force on the carrier tape 17 in the direction towards the carrier tape supply roll 7, is not large enough to move the feed roll 25 past the detent tooth 34, overcoming the detent force exerted by the return detent member 33. Thus, on continued rotation of the type wheel 13 a slipping occurs between the guard plate 21 and the carrier tape 17 with the pressure-sensitive labels 8 disposed thereon so that the carrier tape is not pulled back any further.

In this operating phase, in which the carrier tape is stationary due to the feed roll 25 held fixed by the return detent member 32, the type wheel 13 and thus also the pressure roller 22 driven thereby move further into the positions illustrated in FIG. 3. The print segment 15 reaches a position adjoining the printing zone 16 and the pressure roller 22 also starts to press the carrier tape against the type wheel because its peripheral portion 47 now comes into engagement with the type wheel. In this operating phase the drive wheel 36 also moves further so that the return pawl 40 moves into the position illustrated in FIG. 6 relatively to the stationary feed roll 25. FIG. 6 shows the return pawl 40 in the position in which it just comes into engagement with the return drive tooth 41. If the drive wheel 36 is now further rotated (anticlockwise in FIG. 3 and clockwise in FIG. 6) by the toothed wheel 12 due to the further movement of the operating lever 2 the feed roll 25 is further rotated by the return pawl 40 due to the action thereof on the return drive tooth 41, overcoming the detent force exerted by the return detent member 33 on the detent tooth 34, and as a result the carrier tape 17 can now again move as in the initial phase in the return direction. At the same time, the carrier tape 17 with the pressure-sensitive label 8 disposed thereon is pressed by the peripheral portion 47 of the pressure roller 22 against the type wheel 13 so that in the printing zone 16 the types present in the printing segment 15 roll on the pressure-sensitive label 8 to produce an imprint. Since the pressure roller 22 is driven via a tooth connection by the type wheel 13 the movement of the carrier tape now taking place is in the return direction exactly synchronously with the movement of the type wheel 13 and of the pressure roller 22 because the carrier tape 17 is entrained during the rolling of the peripheral surfaces. From the start of the renewed transport of the carrier tape 17 in the return direction onwards the carrier tape is further moved in the return direction until the entire printing segment 15 has rolled over the pressure-sensitive label 8 in the printing zone 16. The operating lever 2 has then reached its working position in which it is completely squeezed against the grip 5. In the example of embodiment illustrated the carrier tape 17 had thus moved a total of about one and a half label lengths in the return direction.

When the operating lever 2 is now released and again returns under the action of a spring between said lever and the grip 5 into its rest position illustrated in FIG. 1, the directions of rotation of all the drive members described are reversed. To be exact, this means that the toothed segment 9 now rotates clockwise about the axis 4 which results in a rotation of the pinion 10 and the toothed wheel 12 anticlockwise. Accordingly, the type wheel 13 also moves clockwise and thus drives the pressure roller 22 anticlockwise. The drive wheel 36 rotates in the illustration of FIGS. 2 and 3 clockwise and consequently due to the engagement of the forward pawls 38 on the forward detent teeth 39 entraines the feed roll 25. The return stop 32 presents no obstacle to such a rotation of the feed roll 25 because the return detent member 33 can readily overrun the detent teeth 34 in the case of this direction of rotation of the feed roll 25.

At the start of the rotation of the type wheel 13 clockwise the printing segment 15 again rolls over the pressure-sensitive label 8 since the latter again moves between the type wheel 13 and the pressure roller 22.

The transmission ratios between the toothed segment 9, the pinion 10, the toothed wheel 12 and the drive wheel 36 are so chosen that during the return of the operating lever 2 from the working position to the rest position the carrier tape 17 is moved in the forward direction indicated by the arrow 24 through a distance which is equal to the distance of the peel edge 23 from the printing zone 16 plus one label length. Because of this dimensioning the label 8 which was directly behind the peel edge 23 before the start of the operating cycle assumes after completion of said cycle the dispensing position defined by the label 8 indicated in dashed line in which it is detached from the carrier tape 17 and can be applied to an article.

The differing travel in the return direction and in the forward direction is achieved in that the return means slips in defined manner with respect to the carrier tape so that not all the pivot movement of the operating lever 2 from the rest position to the working position is converted into a travel of the carrier tape in the return direction. The opposite direction of movement of the operating lever 2 from the working position to the rest position is however completely converted to a travel of the carrier tape in the forward direction. To ensure that the difference between the travel in the return direction and the travel in the forward direction corresponds exactly to one label length, after the feed roll 25 becomes stationary the drive wheel 36 is further rotated relatively thereto until engagement of the return pawl 40 on the return drive tooth 41 through an angle which corresponds on the periphery of the feed roll 25 to an arc having the length of a pressure-sensitive label.

The pressure-sensitive label 8 disposed directly at the peel edge 23 in the basic position of the hand labelling apparatus 1 illustrated in FIG. 2 is not imprinted because, as apparent from the above outline of the operating cycle, it is imprinted only in the course of the rearwardly directed travel in an operating cycle when it moves into the printing zone 16. The imprint produced on the pressure-sensitive label 8 can thus readily be changed without any danger of a label provided with an unchanged imprint being applied to an article which should bear a label with the new imprint. It is thus not possible with the apparatus described to dispense a label bearing an imprint not corresponding to the print types set at the printing segment of the type wheel.

What we claim is:

1. A hand labelling apparatus for printing and dispensing labels from a label strip including a carrier tape and said labels adhered to said tape, said apparatus comprising a label strip supply roll;

a peel edge disposed downstream of said supply roll;

a tape feed mechanism disposed downstream of said peel edge and engaging said carrier tape to stepwise feed the label strip in a forward direction to said peel edge at which point the carrier tape is deflected around the peel edge and the labels are substantially separated from the carrier tape;

a printing mechanism disposed upstream of the peel edge having changeable type and movable from a non-printing position to a printing zone for printing predetermined information on successive labels, the distance between the printing zone and peel edge exceeding the length of each of said labels so that one of said labels will be disposed between the peel edge and the printing zone after each stepwise feeding of the label strip to said peel edge by the tape feeding mechanism;

return means for feeding the label strip in a return direction opposite to said forward direction;

an operating lever pivotable between a rest position and a working position, means for connecting said operating lever to said return means and said tape feed and printing mechanisms so that (a) during movement of the operating lever from the rest position to the working position, said return means feeds said one label in said return direction to said print zone, (b) said one label is then printed by said printing mechanism, and (c) during movement of the operating lever from its working position to its rest position, the printed label is fed in the forward direction by the tape feed means to the peel edge where it is substantially separated from the carrier tape;

return stop means for disabling the return means for a predetermined portion of the movement of the operating lever between its rest and working positions so that the label strip movement in the forward direction in response to movement of said operating lever from the working position to the rest position exceeds that in the return direction by an amount equal to the length of one label whereby in response to the movement of the operating lever to its rest position the last printed label is moved past said peel edge and no printed labels remain in said labelling apparatus even though the distance between said peel edge and the printing zone exceeds the length of each label.

2. An apparatus as claimed in claim 1 where the return means includes a wheel driven by the operating lever and a roller which holds the carrier tape positively against the peripheral surface of said wheel.

3. An apparatus as claimed in claim 2 where the wheel driven by the operating lever is a type wheel of a rotary printing mechanism which includes at its periphery a printing segment having printing types which roll over the labels on the carrier tape as the labels move into the printing zone on rotation of the type wheel.

4. Apparatus as in claim 3 where said return stop means includes means for holding the carrier tape in place and preventing movement thereof such that the tape slips between the wheel and roller during the predetermined movement of the operating lever.

5. Apparatus as in claim 4 where said tape feed mechanism includes means for enabling said return stop means when said one label reaches said printing zone until the printing segment reaches the printing zone and further means for disabling the return stop means when the printing segment reaches the printing zone so that said label can be printed.

6. Apparatus as in claim 5 where said tape feed mechanism comprises a feed wheel which engages said carrier tape to effect the feeding thereof in said forward direction in response to said movement of the operating lever from its working position to its rest position where said feed wheel is rotatably mounted on a shaft and where said return stop means includes a detent member and a return stop tooth internally disposed on said feed wheel such that, upon rotation of said feed wheel in the return direction, said detent engages said tooth to prevent rotation of the feed wheel and thus movement of the carrier tape.

7. Apparatus as in claim 6 where said means for disabling the return stop means includes a return pawl operatively connected to said operating lever, a return tooth internally disposed on said feed wheel, and means for engaging said return pawl with said return tooth after said predetermined movement of the operating lever to thus move the detent out of engagement with the return stop tooth and thus permit further movement of the carrier tape in the return direction.

8. A hand labeling apparatus which in a working cycle imprints and dispenses pressure-sensitive labels adhering to a carrier tape, comprising a feed means which under the control of an operating lever which is pivotal between a rest position and a working position draws the carrier tape stepwise about a peel edge at which in each working cycle, a pressure-sensitive label on feeding in a forward direction detaches from the carrier tape and moves into a dispensing position, and a printing mechanism which in each working cycle at a printing zone remote from the peel edge in a direction oppositely to the forward direction produces an imprint on a pressure-sensitive label, wherein the feed means comprises a tape feed mechanism which includes a return means for moving the carrier tape in the return direction opposite the forward direction through by at least a distance which is equal to the distance of the peel edge from the printing zone and which further includes a means for moving the carrier tape in the forward direction through the same distance plus one label length, a return stop being provided which renders the return means inoperative after said return means has moved the carrier tape through a predetermined distance in the return direction, the forward means being connected with the operating lever via a directional ratchet mechanism which for a tape movement in the forward direction holds the forward means coupled to the operating lever and releases said means for the tape movement in the return direction, the forward means including a feed roll which is rotatably mounted on a shaft and about which the carrier tape is led and the peripheral surface of which is provided with projections which engage in recesses in the carrier tape, the shaft of the feed roll having a drive wheel driven by the operating lever which is freely rotatably mounted and the directional ratchet having a forward pawl rigidly connected to the drive wheel and forward detent teeth disposed on the feed roll, the return means being constructed such that said means exerts on the carrier tape in the return direction a limited entraining force which can be overcome by a tape tension exerted in the forward direction on the carrier tape, the return stop being formed by a return detent member and detent teeth on the feed roll which are adapted to be brought into engagement therewith and which on said engagement with the return detent member block the movement of the feed roll, a return pawl rigidly connected to the drive wheel of the feed roll and adapted to be brought into engagement with return drive teeth on the feed roll, the return detent member being held positively in engagement with the detent teeth on the feed roll and on movement of the feed roll moved in the return direction over the detent teeth when the drive wheel rotates the feed roll via the engagement between the return pawl and a return drive tooth in the return direction.

9. An apparatus as claimed in claim 8 wherein at the start of an operating cycle a detent tooth in the peripheral direction of the feed roll is remote from the return detent member a distance such that in the course of an operating cycle the engagement of the return detent member on the detent tooth does not take place until the carrier tape has moved in the return direction to such an extent that the leading edge, seen in the return direction, of the pressure-sensitive label adjoining the peel edge at the start of an operating cycle has reached the printing zone, and the drive wheel of the feed roll after start of the engagement of the return detent member on the detent tooth can be rotated up to engagement of the return pawl on the return drive tooth relatively to the feed roll through an angle which corresponds at the periphery of the feed roll to an arc having the length of a pressure-sensitive label.

10. An apparatus as claimed in claim 8, wherein the return means includes a wheel driven by the operating lever and a roller which holds the carrier tape positively against the peripheral surface of said wheel.

11. An apparatus as claimed in claim 10, wherein the maximum entraining force exerted by the roller on the carrier tape is smaller than the force necessary to overcome the detent force with which the return detent member is held positively in engagement with a detent tooth.

12. An apparatus as claimed in claim 10 or 11, wherein the wheel driven by the operating lever is the type wheel of a rotary printing mechanism which is in drive connection with the operating lever and which comprises at its periphery a printing segment having printing types which rolls over a pressure-sensitive label on the carrier tape when the pressure-sensitive label moves into the printing zone on rotation of the type wheel controlled by the operating lever.

* * * * *